United States Patent [19]

Torita

[11] 4,335,592

[45] Jun. 22, 1982

[54] AUTOMATIC WASHER

[75] Inventor: Fumio Torita, Nagoya, Japan

[73] Assignee: Tokyo Shibaura Denki Kabushiki Kaisha, Kawasaki, Japan

[21] Appl. No.: 210,532

[22] Filed: Nov. 25, 1980

[30] Foreign Application Priority Data

Nov. 26, 1979 [JP] Japan ..... 54-153317

[51] Int. Cl.[3] ..... D06F 33/02; D06F 39/08

[52] U.S. Cl. ..... 68/12 R; 68/207

[58] Field of Search ..... 68/12 R, 207

[56] References Cited

U.S. PATENT DOCUMENTS 3,498,090 3/1970 Mason ..... 68/207

FOREIGN PATENT DOCUMENTS 53-32971 3/1978 Japan .
53-32976 3/1978 Japan .
53-142053 12/1978 Japan .
54-68071 5/1979 Japan ..... 68/207
54-132365 10/1979 Japan ..... 68/12 R
54-132366 10/1979 Japan ..... 68/12 R

*Primary Examiner*—Philip R. Coe
*Attorney, Agent, or Firm*—Cushman, Darby & Cushman

[57] ABSTRACT

With an automatic washer embodying this invention, a stirring blade member is rotatably provided in a basket set in a tub. A torque of a motor is transmitted to the stirring blade member by means of a drive transmission. A water supply control system is set in a central processing unit. Where wash water is filled in the tub to a predetermined or standard level, then a water valve is closed. A number of rotations of the stirring blade member in the wash water in which material of washing is dipped is detected by a rotation detector. A length of time for which the water valve is to be left open is determined from the number of rotations of the stirring blade member. The water valve is left open for a calculated length of time.

10 Claims, 7 Drawing Figures

AUTOMATIC WASHER

This invention relates to an automatic washer, and more particlarly to an automatic washer which carries out washing by automatically controlling a series of steps of material of washing and dehydrating the cleaned material of washing.

Where, with the conventional automatic washer, an amount of wash water is determined in accordance with a charged quantity of material of washing put in a tub, the operator has to choose any of two or three predetermined levels of wash water. With the prior art automatic washer in which an amount of wash water supplied to the tub is preset at, for example, three levels, that is, "high", "medium" and "low", the operator who subjectively regards a quantity of material of washing as large selectively depresses the "high" button from among the water level-presetting switch buttons. At this time, wash water is supplied to the tub, until the preset high water level is reached. Conversely where the operator judges a quantity of material of washing to be small, then he selectively depresses the "low" button from among the water level-presetting switch buttons. As a result, wash water is filled in the tub, until the preset low water level is reached.

Therefore, the above-mentioned type of automatic washer has the drawback that an optimum amount of wash water cannot always be provided for a batch of material of washing to be actually washed each time. The first reason for this difficulty is that an amount of wash water can be preset only at one of two or three levels for a quantity of material of washing to be washed one batch after another. The second reson is that an amount of wash water is only determined from the operator's unreliable subjective judgement. To date, therefore, it has been impossible to properly control an amount of wash water for a quantity of material of washing which minutely varies from time to time. For instance, where too small an amount of wash water is supplied to a tub for a given quantity of material of washing, then the washing is not smoothly related in the water. As a result, a stirring blade member directly bits the material of washing the damage, for example, its fabric. Conversely where too large an amount of wash water is applied for a given quantity of material of washing, then the wash water is simply wasted.

Description has been given of a relationship between a quantity of material of washing and an amount of wash water supplied to a tub. The above-mentioned difficulties also arise with respect to a relationship between a quantity of material of washing and an amount of a detergent. With the prior art automatic washer, therefore, the fabric of material of washing, for example, is damaged, and/or water or a detergent is washed, while the operator is unaware of such event. Various types of washers have already been developed which are designed to control an amount of wash water for the purpose of resolving the aforementioned drawbacks. The proposed type of automatic washer is provided with a weight detector for measuring the weight of material of washing put, for example, in the tub. Thus, an amount of wash water is controlled in accordance with the measured weight of material of washing. The proposed type of automatic washer indeed eliminates part of the aforesaid difficulties accompanying the preceding type of automatic washer, namely, dispenses with the operator's subjective judgement regarding an amount of wash water, and saves the operator from a troublesome work of subjectively presetting an amount of wash water, each time washing is undertaken. However, as far as washing is concerned, a quantity of material of washing can not be determined solely from its weight. Most of material of washing is generally formed of clothing. In other words, the physical quantity of material of washing varies with the size and quality of clothing. Therefore, an optimum amount of wash water is appreciably affected by the kind of clothing. For instance, where an amount of wash water is determined merely from a weight of material of washing made of light weight material, then an amount of wash water supplied to the tub becomes deficient. As a result, the material of washing cannot be smoothly rotated in the tub, with a resultant failure to ensure optimum washing. Therefore, any of the conventional automatic washer cannot fully control an amount of wash water to be supplied to the tub.

It is accordingly the object of this invention to provide an automatic washer capable of automatically presetting an optimum amount of wash water and detergent for a charged quantity of material of washing put in the tub each time.

With an automatic washer embodying this invention, wash water is filled in the tub holding material of washing up to a level preset for the quantity of the material of washing. Determination is made of the number of rotations with which a stirring blade member is rotated per unit time in the water in which material of washing is dipped. Amounts of wash water and detergent to be additionally supplied are determined from the number of rotation of the stirring blade member with reference to a pedetermined data-converting means. Consequently, wash water and detergent are additionally supplied in amounts thus determined.

This invention can be more fully understood from the following detailed description when taken in conjunction with the accompanying drawings, in which.

Figure 1:
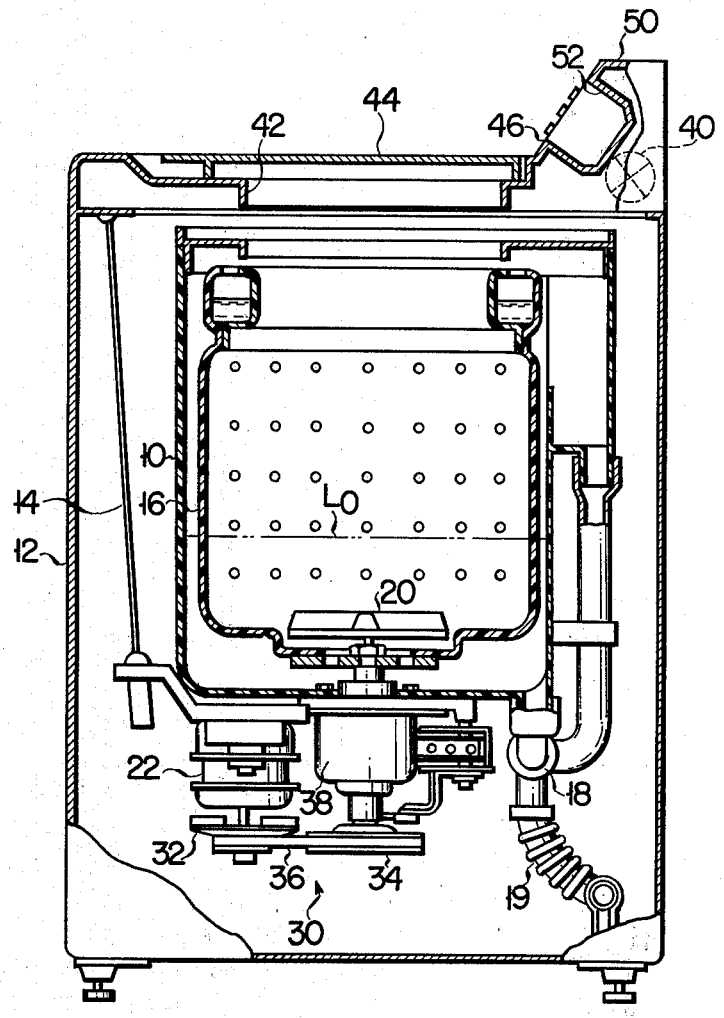
FIG. 1 is a sectional view of an automatic washer embodying this invention.
Figure 4:
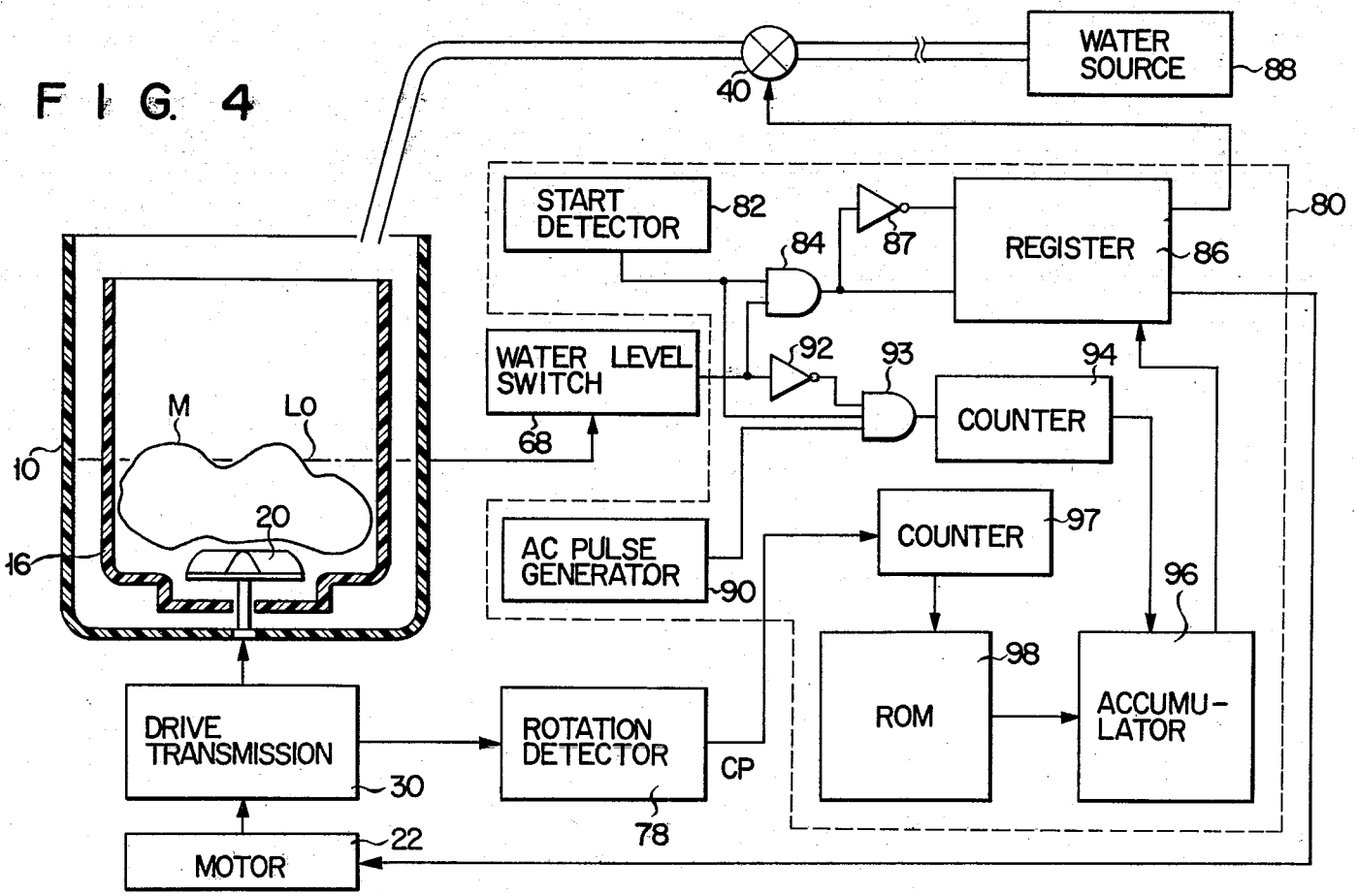
Figure 5:
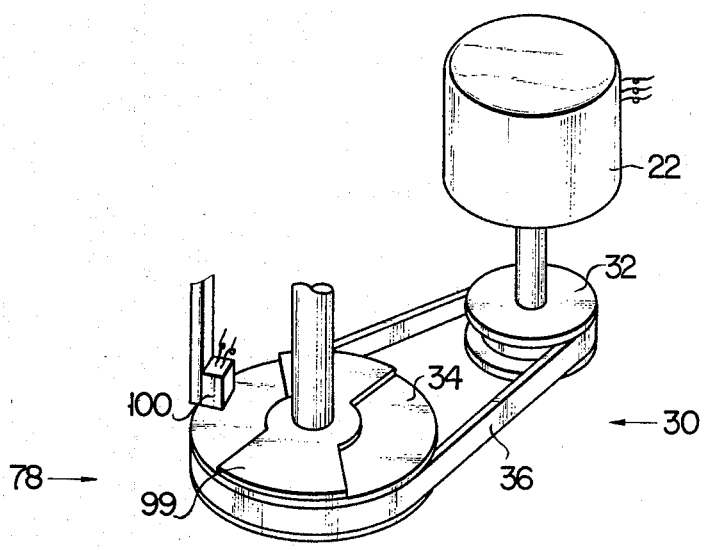
Figure 6:
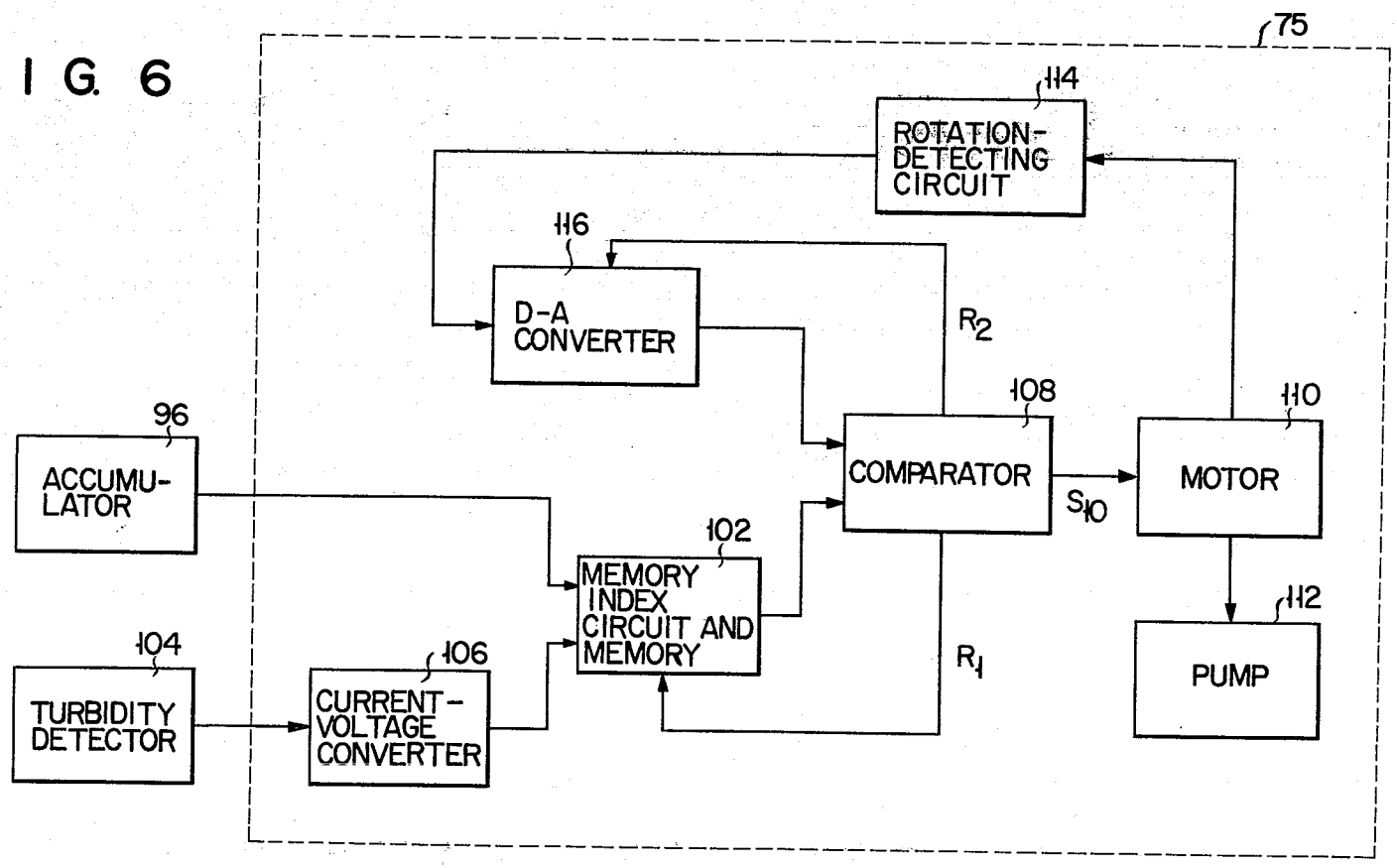
Figure 7:
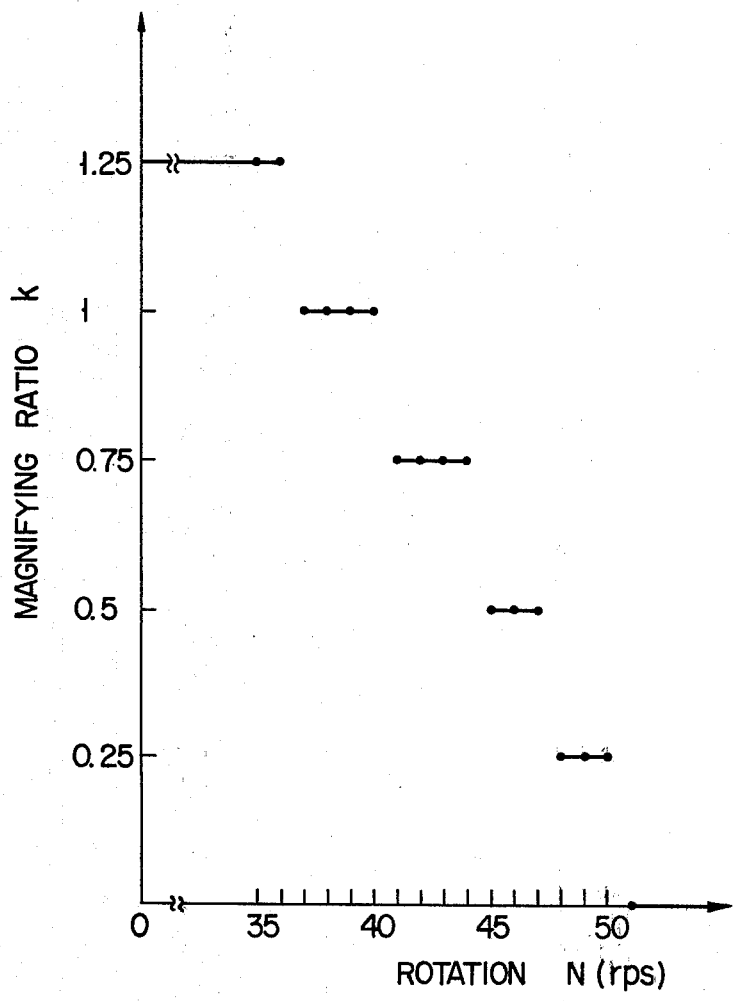

FIG. 4 schematically shows a control circuit of the automatic washer of FIG. 1;

FIG. 5 is an oblique view of the whole of a drive control mechanism of the automatic washer of FIG. 1;

FIG. 6 is a block circuit diagram of a detergent feeder used with the automatic washer of FIG. 1; and FIG. 7 graphically indicates interrelationships between the number of rotations N of the stirring blade member and the magnifying ratio k in which the per second number of rotations N is multiplied to determine an amount of wash water to be additionally supplied.

Figure 2:
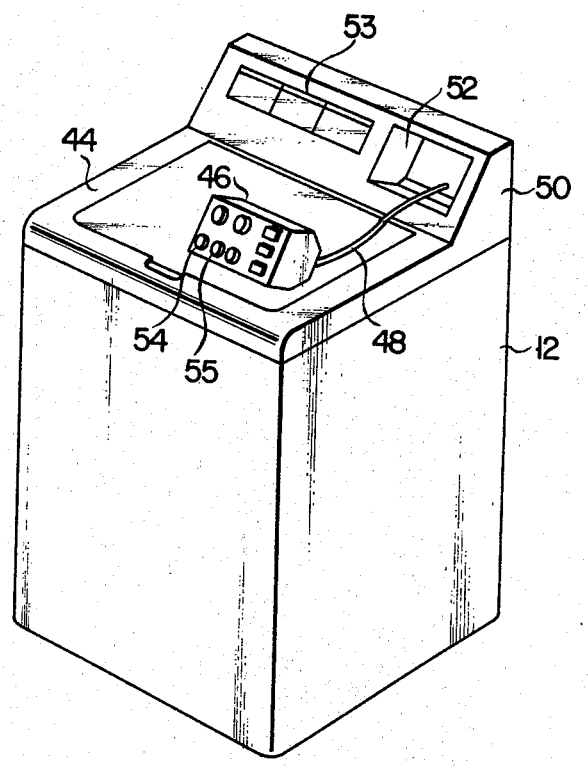
FIG. 2 is an oblique external view of the automatic washer of FIG. 1.

Referring to FIGS. 1 and 2 showing an automatic washer embodying this invention, a tub 10 is vertically and movably built in an outer case 12 by means of an elastic support 14. The tub 10 is disposed outside of a basket 16 used concurrently for the washing and dehydrating of material of washing. Provided in the corner of the bottom of the tub 10 is a water drain valve 18 coupled to a water-draining passage 19. Rotatably provided at the center of the bottom of the tub 10 is a stirring blade member 20 connected to a motor 22 through a drive transmission 30. The drive transmission 30 includes pulleys 32, 34, a belt 36, and clutch mechanism 38, thereby to selectively transfer a motor torque either to the stirring blade member 20 or to the basket 16. A water valve 40 controls an amount of wash water supplied to the tub 10. Reference mark $L_0$ (FIG. 1) shows a water level in the tub 10 predetermined regardless of a quantity of material of washing to be put therein (hereinafter referred to as "the standard water level"). Provided in the upper part of the outer case 12 are an opening 42 and a lid 44.

Referring to FIG. 2, a switch box 46 is connected to a control box 50 by means of a cable 48. The control box 50 comprises a cavity 52 and display 53. Normally, the switch box 46 is detachably placed in the cavity 52. Where the washer of FIG. 2 is applied, the switch box 46 is pulled out of the cavity 52 by an operator standing in front of the washer and operated by his fingers. Mounted on the front panel of the switch box 46 are various knobs 54, 55, . . . such as a power switch knob, program-selecting switch knob, etc. The display 53 is provided with known lamps for indicating by means of a light the various steps of an operation cycle (such as "washing", "rinsing" and "dehydrating") and an amount of a detergent to be used ("large", "medium" and "small"). Transmission of a signal from the switch box 46 to the control box 50 need not be effected through the cable 48, but may be carried out by causing a signal light emitted from the switch box 46 to be received by optical means provided in the control box 50.

Figure 3:
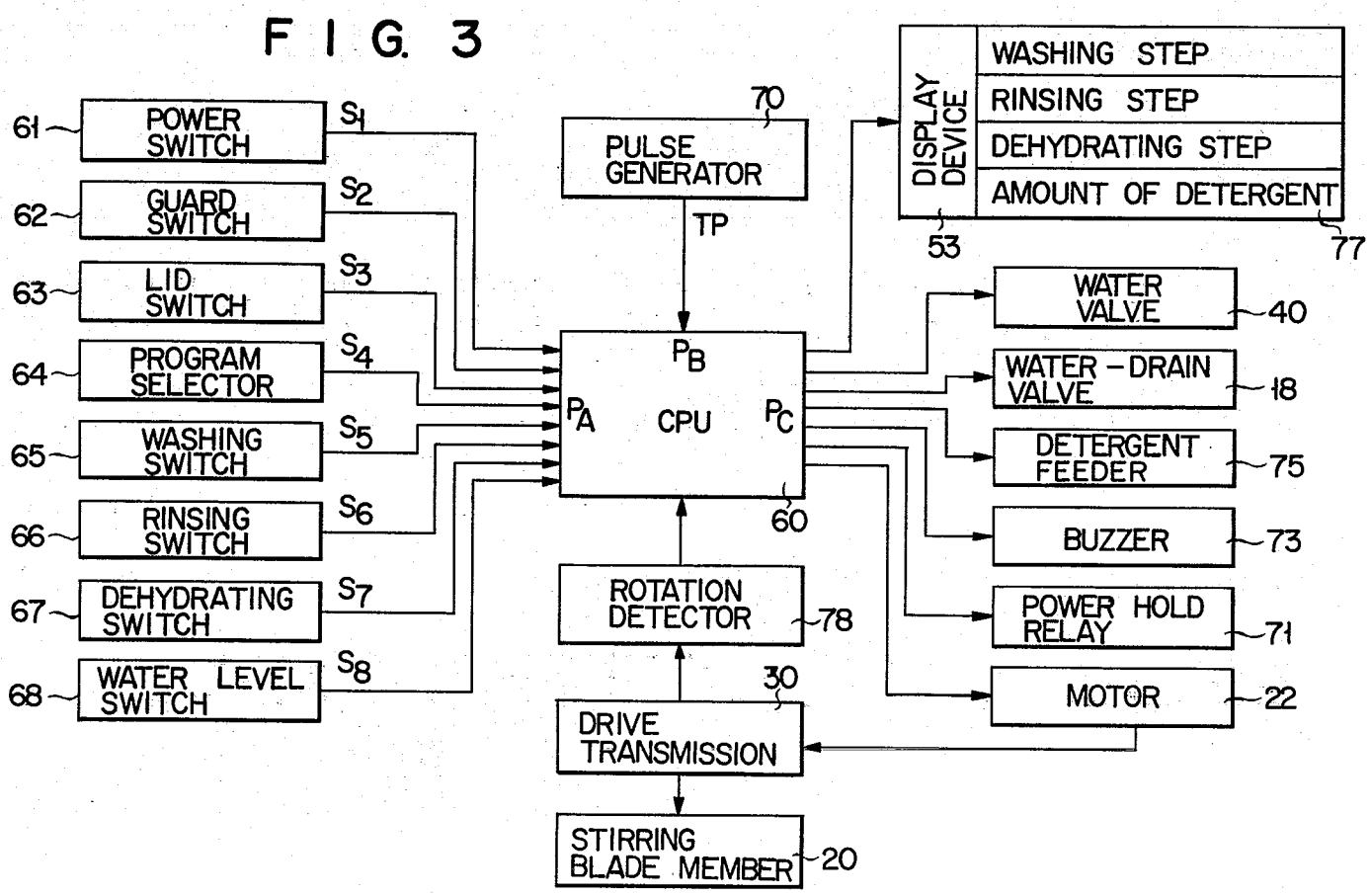
FIG. 3 is a block circuit diagram of the automatic washer.

Description is now given with reference to FIG. 3 of the block circuit diagram of an automatic washer embodying this invention. A central processing unit (abbreviated as CPU) 60 comprises a process control section (not shown) for causing the automatic washer to carry out a series of steps extending from water supply to dehydrating automatically and continuously, and the later-described water-supply control system for adjusting an amount of wash water to be supplied to the tub 10 at a given point of time. The input terminals $P_A$ of the CPU 60 receive output signals $S_1$ to $S_8$ from the undermentioned switches. Signal $S_1$ is generated from a power switch 61 when thrown in. Stop signal $S_2$ is sent forth from a guard switch 62 actuated when abnormal shaking occur by the rotation of the basket 16, for example, to dehydrate the material of washing. Stop signal $S_3$ is delivered from a lid switch 63 operated when the lid 44 is not completely closed. Where a program selector 64 chooses one of a plurality of programs representing various combinations of washing steps (programs designed, for example, to effect "a standard washing", "a simple washing", etc.), when the program selector 64 produces a signal $S_4$ representing a selected program. A washing switch 65 for changing over the running speed of wash water during the washing step, for example, from "high" to "low" or vice versa generates a changeover-instructing signal $S_5$. A rinsing switch 66 for changing over the stream speed of wash water during the rinsing step from "high" to "low" or vice versa sends forth a changeover-instructing signal $S_6$. A dehydrating switch 67 for changing over the rotating speed of the basket 16 during the dehydrating step from "high" to "low" or vice versa emits a changeover-instructing signal $S_7$. A water level switch 68 generates a water level signal $S_8$ denoting the standard level $L_0$ (FIG. 1) when the water in the tub 10 reaches said level $L_0$. A pulse generator 70 emits clock pulses TP (having a frequency of, for example, 245.76 KHz) synchronizing with the frequency of power source voltage. The clock pulses TP are supplied to another input terminal $P_B$ of the CPU 60. A plurality of output terminals $P_C$ of the CPU 60 are connected to a motor 22, power hold relay 71, water valve 40, buzzer 73, water drain valve 18, detergent feeder 75 and display 53, etc. The power hold relay 71 relays source voltage to be impressed on the automatic washer. The water valve 40 controls an amount of wash water supplied from a source (for example, waterworks). The buzzer 73 is actuated when the whole washing cycle of the washer is brought to an end. The detergent feeder 75 automatically supplies a detergent to the tub 10. The display 53 indicates by a light the continuation of the steps of washing, rinsing and dehydrating and an amount of a detergent to be supplied to the tub 10. A torque of the motor 22 is transmitted to the stirring blade member 20 through the drive transmission 30, an output signal from which is fed back to the CPU 60 through the rotation detector 78.

Referring to a block diagram (FIG. 4) of a water supply control system 80 provided in the CPU 60, a start detector 82 is connected to one of the input terminals of an AND circuit 84. The output terminal of the water level switch 68 is directly connected to the other input terminal of the AND circuit 84, whose output terminal is directly connected to one of the three input terminals of a register 86 and also another input terminal of the register 86 through an inverter 87. One of the output terminals of the register 86 is connected to the motor 22. The other output terminal of the register 86 is connected to the water valve 40 coupled to a water source 88. The output terminal of the water level switch 68 is further connected to one of the three input terminals of an AND circuit 93 through an inverter 92. The output terminal of the start detector 82 is also connected to one of the remaining input terminals of the AND circuit 93. The output terminal of an AC pulse generator 90 is connected to the other of the remaining input terminals of the AND circuit 93, whose output terminal is connected to one of the input terminals of an accumulator 96 through a counter 94. The drive transmission 30 connected to the motor 22 is further coupled to the input terminal of a counter 97 through the rotation detector 78. The output terminal of the counter 97 is connected to the other input terminal of the accumulator 96 through a read-only memory (ROM) 98. The output terminal of the accumulator 96 is connected to the other of the remaining input terminals of the register 86.

As shown in FIG. 5, the rotation detector 78, for example, comprises a rotatable magnet board 99 fixed to the upper surface of the driven pulley 34 coupled to the clutch mechanism 38 (FIG. 1) and having a uniform predetermined thickness, and a magnet switch 100 positioned above the periphery of the driven pulley 34 at a space just sufficient to allow for the passage of the edge of the rotatable magnet board 99. The magnet switch 100 is closed, each time the magnet board 99 is rotated toward the proximity of the magnet switch 100. At this time, the rotation detector 78 generates count pulses CP in a number corresponding to the number of rotations of the stirring blade member 20 (FIG. 1) coupled to the driven pulley 34. The count pulses are supplied to the water supply control system 80 (FIG. 4) provided in the CPU 60.

Referring to FIG. 6, showing the block circuit diagram of the detergent feeder 75, the output terminal of an accumulator 96 provided in the water supply control system 80 is connected to one of the three input terminals of a memory index circuit and memory 102. The output terminal of a turbidity detector 104 is connected to another input terminal of the memory index circuit and memory 102 through a current voltage converter 106. The turbidity detector 104 comprises, for example, a light-emitting diode (LED) and phototransistor, and optically detects the turbidity of wash water. The output terminal of the memory index circuit and memory 102 is connected to one of the two input terminals of a comparator 108, whose output terminal is connected to a motor 110. One of the two output terminals of the motor 110 is connected to a pump 112 which supplies a detergent (not shown) to the tub 10 (FIG. 4). The other output terminal of the motor 110 is connected to a D-A converter 116 through a rotation-detecting circuit 114. The output terminal of the D-A converter 116 is connected to the other input terminal of the comparator 108. Reset signals $R_1$, $R_2$ supplied from the comparator 108 are respectively transmitted to the memory index circuit and memory 102 and D-A converter 116.

With an automatic washer embodying this invention which is arranged as described above, the CPU 60 controls a series of steps extending from washing to dehydrating in accordance with programs denoted by the aforesaid input signals $S_1$ to $S_8$ supplied to the input terminals $P_A$ of CPU 60. However, reference is made hereunder particularly to the method of controlling the steps of supplying wash water and detergent which are directly related to the object of this invention. The lid 44 is closed after the material of washing M is placed in the basket 16 provided in the tub 10. When the power switch 61 is closed, then the water valve 40 is actuated to cause wash water to be supplied to the tub 10. Where the wash water supplied to the tub 10 reaches the standard level $L_0$, then the water level switch 68 is operated to send forth a water level signal $S_8$ to the water supply control system 80 provided in the CPU 60. The water level signal $S_8$ is transmitted to the register 86 through the AND circuit 84 of the water supply control system 80. When receiving the water level signal $S_8$, the register 86 sends forth a signal for temporarily closing the water valve 40. At this time, a signal denoting a length of time $T_1$ required for the wash water in the tub 10 to reach the standard level $L_0$ is delivered from the counter 94 to the accumulator 96. When receiving a signal from the register 86 of the water supply control system 80, the motor 22 is supplied with power for a prescribed length of time (about 0.2 to 3 seconds), for example, 1 second. As a result, the stirring blade member 20 is rotated in the water in which the material of washing M is dipped. The number of rotations of the stirring blade member 20 is detected by the rotation detector 78, which in turn produces count pulses CP corresponding the detected number of rotations of the stirring blade member 20. The generated count pulses CP are transmitted to the counter 97 of the water supply control system 80. The counter 97 determine the per second number N of rotations of the stirring blade member 20. The per second number N of rotations varies substantially in inverse proportion to the quantity of the material of washing acting as a load obstructing the rotation of the stirring blade member 20. Magnifying ratios k preset for different per second numbers N of rotations are stored in the ROM 100 as data denoting various amounts of wash water to be additionally supplied. A length of time $T_2(T_2=kT_1-(1))$ arrived at by multiplying the previously detected time $T_1$ of water supply by the magnifying ratio k is arithmetically computed by the accumulator 96. Additional wash water is supplied to the tub 10 through the water valve 40 in an amount corresponding to the arithmetically calculated length of time. A relationship between the magnifying ratio k and the per second number N of rotations of the stirring blade member 20 is defined as shown in FIG. 7. As seen from the graph of FIG. 7, a magnifying ratio k stands at zero when the per second number N of rotations of the stirring blade member 20 exceeds "51", (namely, when the quantity of material of washing M placed in the tub 10 is small as is generally regarded by the operator). In such case, no additional wash water is supplied to the tub 10. Conversely where the per second number N of rotations of the stirring blade member 20 falls below "36" (namely, when the quantity of material of washing M placed in the tub 10 too large for an amount of wash water already supplied), the magnifying ratio k indicates "1.25" with respect to such small per second number N of rotations of the stirring blade member 20. In this case, the register 86 of the water supply control system 80 sends forth a water valve-opening signal for a length of time calculated as $$T_2=1.25\times T_1(\text{sec})$$

from the aforesaid formula (1). As a result, the water valve 40 is opened to cause wash water to be additionally supplied to the tub 10 in an amount substantially 1.25 times larger than that of the previously supplied wash water. Obviously, the magnifying ratios of FIG. 7 were experimentally determined to render a total amount wash water held in the tub 10 after its replenishment optimum for the quantity of washing M placed in the tub 10.

Description is now given of the detergent feeder 75 with reference to FIG. 6. The turbidity detector 104 generates a current signal corresponding to the turbidity of wash water held in the tub 10. This current signal is converted into a voltage signal by the current-voltage converter 106. The memory index circuit and memory 102 sums up a voltage signal delivered from the current-voltage converter 106 and a signal sent forth from the accumulator 96 which denotes the time $T_2$ for which wash water is to be additionally supplied, and stores the added data. The motor 110 is rotated upon receipt of a signal from a water supply start detector (not shown) provided in the CPU 60. As a result, the pump 112 is actuated to supply the tub 10 with a detergent. The number of rotations of the motor 110 is detected in the form of pulses by the rotation detecting circuit 114. The pulses are converted by the D-A converter 116 into a voltage signal corresponding to the frequency of the pulses. Where coincidence takes place between a voltage signal supplied from the D-A converter 116 and a voltage signal issued from the memory index circuit and memory 102, then the comparator 108 causes a stop signal $S_{10}$ to be transmitted to the motor 110. At this time, the comparator 108 further transmits reset signals $R_1$, $R_2$ to the memory index circuit and memory 102 and D-A converter 116. Since, at this time, the pump 112 is stopped, the supply of a detergent is brought to an end.

With an automatic washer embodying this invention, wash water is first supplied to the tub 10 in which washing M is placed, as previously described, until wash water held in the tub 10 reaches the standard level $L_0$. A length of time $T_1$ required for the standard level $L_0$ to be reached is stored in the register 86. Detection is made of the per second number N of rotations of the stirring blade member 20 in the water in which the material of washing M is dipped. A magnifying ratio k corresponding to the per second number N of rotations of the stirring blade member 20 is determined. Wash water is additionally supplied to the tub 10 only for a length of time calculated as $T_2=kT_1$. As a result, an optimum amount of additional wash water is easily supplied to the tub 10 for the material of washing M held therein. This arrangement suppresses the waste of wash water and detergent and also prevents the fabric of material of washing M from being damaged during the washing step due to the deficiency of wash water which might arise in the reverse case. In the initial stage of the washing step, the stirring blade member 20 is temporarily rotated while wash water is not yet sufficiently supplied, in order to determine a length of time required for wash water to be later additionally supplied in a sufficient amount. However, the period during which the stirring blade member 20 is temporarily rotated is only of the order of 0.2 to 3 seconds. Therefore, the fabric of the material of washing M is little likely to be damaged by the temporary rotation of the stirring blade member 20.

Although the present invention has been shown and described with respect to a particular embodiment, nevertheless, various changes and modifications which are obvious to a person skilled in the art to which the invention pertains are deemed to lie within the spirit, scope and contemplation of the invention. For example, where the per second number N of rotations of the stirring blade member 20 initially rotated for determination of a length of time for which wash water is to be additionally supplied to the tub falls below the lowest level (below "36" shown in the graph of FIG. 7), then it is possible to additionally supply wash water to the tub 10 only for a length of time equal to the length of time $T_1$ initially required for wash water to be filled in the tub until the standard level $L_0$ is reached. Later, the stirring blade member 20 is again rotated, for example, for one second. The number N of rotations of the stirring blade member 20 during the one second is detected. The magnifying ratio k is determined from the number N of rotations with reference to the graph of FIG. 6. The water supply control system 80 may be so programmed as to cause wash water to be again supplied to the tub 10 for a length of time corresponding to $kT_1$ as in the aforementioned case. Further, it is not always necessary to provide both detergent feeder 75 and detergent supply display 77. It will well serve the purpose, if at least one of the both devices is provided.

What is claimed is:

1. An automatic washer comprising:

a tub having a bottom wall for holding at least wash water;

water valve means for controlling an amount of wash water to be supplied to said tub;

a stirring blade member rotatably provided inside of said bottom wall of said tub;

drive means for rotating said stirring blade member;

measuring means connected to said drive means for detecting a number of rotations of said stirring blade member per unit time, and sending forth an output signal corresponding to said detected number of rotations;

detecting means for detecting an amount of wash water held in said tub to generate an output signal corresponding to the amount of wash water; and valve control means for closing said water valve in response to said output signal from said detecting means, determining an amount of wash water to be additionally supplied to said tub upon receipt of said output signal from said measuring means, and opening said water valve for a length of time corresponding to said determined additional supply of wash water.

2. An automatic washer according to claim 1, wherein said drive means comprises:

an electric motor; and drive transmission means for transmitting the drive force of said electric motor to said stirring blade member.

3. An automatic washer according to claim 1, wherein said detecting means contains water level switch means fitted to said tub to detect the level of wash water held in said tub and generate a detection signal.

4. An automatic washer according to claim 1, wherein said measuring means at least comprises:

a magnetic board rotatable in the same number of rotations as said stirring blade member; and a magnet switch disposed near said rotatable magnetic board to generate count pulses corresponding to the number of rotations of said rotatable magnetic board.

5. An automatic washer according to claim 1, wherein said valve control means comprises:

means for closing said water valve in response to said output signal from said detecting means;

data-transmitting means for sending forth data on an amount of wash water to be additionally supplied to said tub in response to said output signal from the measuring means; and wash water-additionally supplying means arranged to open said water valve only for a length of time corresponding to data on an amount of wash water to be additionally supplied to said tub, thereby replenishing said wash water held in said tub.

6. An automatic washer according to claim 5, wherein said data-transmitting means comprises:

time-measuring means for measuring a length of time $T_1$ required for wash water to be initially supplied to said level detected by said detecting means;

memory means for storing different wash water-additional supply data corresponding to different numbers of rotations of said stirring blade member;

means for reading from said memory means one of said wash water-additional supply data corresponding to said output signal of said measuring means; and additional water supply time-calculating means for calculating a length of time $T_2$ required for said water valve to be opened from said length of time $T_1$ and said one of said wash water-additional supply data, and opening said water valve means for a length of time corresponding to said length of time $T_2$.

7. An automatic washer according to claim 6, wherein said valve control means contains means for again opening said water valve for a length of time equal to said length of time $T_1$, when said number of rotations detected by said measuring means is smaller than predetermined number.

8. An automatic washer according to claim 1, which comprises detergent feeder means for supplying said tub with an amount of a detergent corresponding to that of said wash water to be additionally supplied.

9. An automatic washer according to claim 8, which comprises means for displaying an amount of a detergent to be additionally supplied to said tub.

10. An automatic washer according to claim 9, wherein said detergent feeder means comprises:

first signal-generating means for generating a first voltage signal corresponding to a total amount of said wash water supplied to said tub;

pump means for feeding a detergent in said tub;

a motor for driving said pump;

second signal-generating means for generating a second voltage signal corresponding to a number of rotations of said motor; and comparator means connected said first and second signal-generating means, for comparing the levels of said first and second voltage signals, and generating a stop signal at least to said motor when said first and second voltage signals are found to have the same voltage level.

* * * * *